US005085765A

United States Patent [19]

Salabé et al.

[11] Patent Number: 5,085,765

[45] Date of Patent: Feb. 4, 1992

[54] CONVEYING AND SEPARATION UNIT FOR BALLISTIC PROJECTILE ARRESTERS

[75] Inventors: Mario Salabé; Adelio Rossi, both of Rome, Italy

[73] Assignee: Impresa Costruzioni Soc. Fra. S.a.r.l., Rome, Italy

[21] Appl. No.: 524,386

[22] Filed: May 17, 1990

[30] Foreign Application Priority Data

May 22, 1989 [IT] Italy ..... 47980 A/89

[51] Int. Cl.[5] ..... B03B 9/00

[52] U.S. Cl. ..... 209/2; 209/147; 209/509; 209/913; 273/394

[58] Field of Search ..... 209/2, 133, 146, 147, 209/483, 509, 606, 645, 913; 273/394, 395, 396, 397, 403, 410; 241/79

[56] References Cited

U.S. PATENT DOCUMENTS

| | | | |
|---|---|---|---|
| 1,728,046 | 9/1929 | Duerr | 209/134 X |
| 2,411,026 | 11/1946 | Conner et al. | 273/102.4 |
| 2,850,162 | 9/1958 | Widmer | 209/134 |
| 3,005,551 | 10/1961 | Kesinger | 209/136 |
| 3,270,879 | 9/1966 | Karlsson et al. | 209/147 X |
| 3,572,503 | 3/1971 | Hezel | 209/120 |
| 3,920,542 | 11/1975 | Laird et al. | 209/134 |
| 4,479,048 | 10/1984 | Kinoshita | 209/913 X |
| 4,728,109 | 3/1988 | Simonetti | 209/925 X |
| 4,786,059 | 11/1988 | Barini | 273/410 |
| 4,824,120 | 4/1989 | Wang | 273/394 X |

*Primary Examiner*—Michael S. Huppert
*Assistant Examiner*—Joseph A. Kaufman
*Attorney, Agent, or Firm*—Mason, Fenwick & Lawrence

[57] ABSTRACT

A conveying and separation assembly for the impact material of a ballistic projectile arrester for indoor firing grounds, of the type that comprises a heap of granulated material as the impact material, and a pneumatic conveyor for sending the granulated material once it has been separated from the exploded projectiles up to the top of said heap. The assembly comprises a variable-diameter worm screw or helical screw, that rotates about a horizontal axis and is arranged within a half cylinder which is open at its upper portion, the worm screw lying in a direction substantially parallel to that from which the projectiles come; a motor for the worm screw; and gravity separation of the exploded projectiles from the granulated material; the half cylinder being connected, at its rear terminal part, with the worm screw or pneumatic conveyor which are employed for sending the material to the top of the heap.

10 Claims, 5 Drawing Sheets

CONVEYING AND SEPARATION UNIT FOR BALLISTIC PROJECTILE ARRESTERS

This invention relates to a conveying and separation apparatus for ballistic projectile arresters, and more particularly to such an assembly that allows a mixture of an impact material and of exploded projectiles to be conveyed and the exploded projectile to be separated before said impact material is sent again up to the top of the heap of the material.

Self-regenerating ballistic projectile arresters have been realized recently, i.e., projectile arresters provided with an automatic system for regenerating the projectile impact material in indoor firing ranges, after separation of the exploded projectiles.

The most innovative solution in this field has been made by the Applicant herein.

In each of them a heap of the impact material was provided, mainly consisting of a granulated material, which was changed by causing the same to run through conveyor belts towards a collection point where the material was separated from the exploded projectiles before moving it to the top of the heap by a mechanical system.

The present invention provides a further improvement in projectile arresters, in particular the assembly for conveying the granulated material and for separating the same from the exploded projectiles.

The assembly according to this invention is useful in existing projectile arresters having the standard chute made up of a ballistic metal plate.

It is a further object of the present invention to provide a projectile arrester which can be installed with an extremely slight lowering of the ground level with respect to the floor-level of the indoor firing range as compared to that required by similar devices.

These and other results are obtained according to the present invention by a conveying and separation assembly of the impact material, said assembly comprising a worm screw which is introduced into the lower portion of the heap of impact material, and rotates about a horizontal axis, said worm screw bearing at its rear end a set of vanes that serve the purpose of disintegrating granulated material that has caked, said assembly also comprising a system for separating the projectiles by gravity.

Accordingly, it is a specific object of the present invention to provide a conveying and separation assembly for the impact material of a ballistic projectile arrester for indoor firing ranges, of the type comprising a heap of granulated material as the impact material, and mechanical means for conveying said granulated material to the top of the heap after separation of the exploded projectiles, wherein said assembly comprises a variable-diameter worm screw that rotates about a horizontal axis and is arranged within a half cylinder which is open at its upper portion, said worm screw lying substantially parallel to the direction from which the projectiles come; means for driving said worm screw; and means for gravity separation of the exploded projectiles from the granulated material; said half cylinder being connected at its rear terminal portion with said converging means.

Obviously, a number of assemblies according to the present invention can be provided in a ballistic projectile arrester, as parallel-arranged units.

According to a preferred embodiment of the assembly of the present invention, a further worm screw is provided on the shaft of the worm screw mentioned previously at the rear end of said shaft and before said separation means, for disintegrating caked granulated material.

Preferably, said variable-diameter worm screw has three or more diameters of different sizes.

The assembly according to the invention can be employed in a ballistic projectile arrester with the impact material according to its free slope.

The driving means of said worm screw are provided in front of the shaft of the worm screw itself.

The assembly according to this invention, which as mentioned above is arranged at a lower level with respect to the impact material heap, can be provided within a specific housing obtained in the floor of the firing range itself, or at the same level as the floor of said firing ground. In that case, a protective plate of a ballistic material can be provided in front of the driving means for the worm screw.

This invention is disclosed in the drawings, wherein.

With reference now to FIGS. 1-4, there is a heap 1 of impact material having exploded ballistic projectiles in it. Below it, multiple-diameter worm screws 2 are provided, which rotate about their horizontal axis, driven by the drive means 3.

Each one of said worm screws 2 has three distinct diameters that increase in the direction along which the material 1 is moved, so that a full renewal of the material itself is ensured, said worm screws moving the granules in a continuous way along their whole length.

Figure 1:
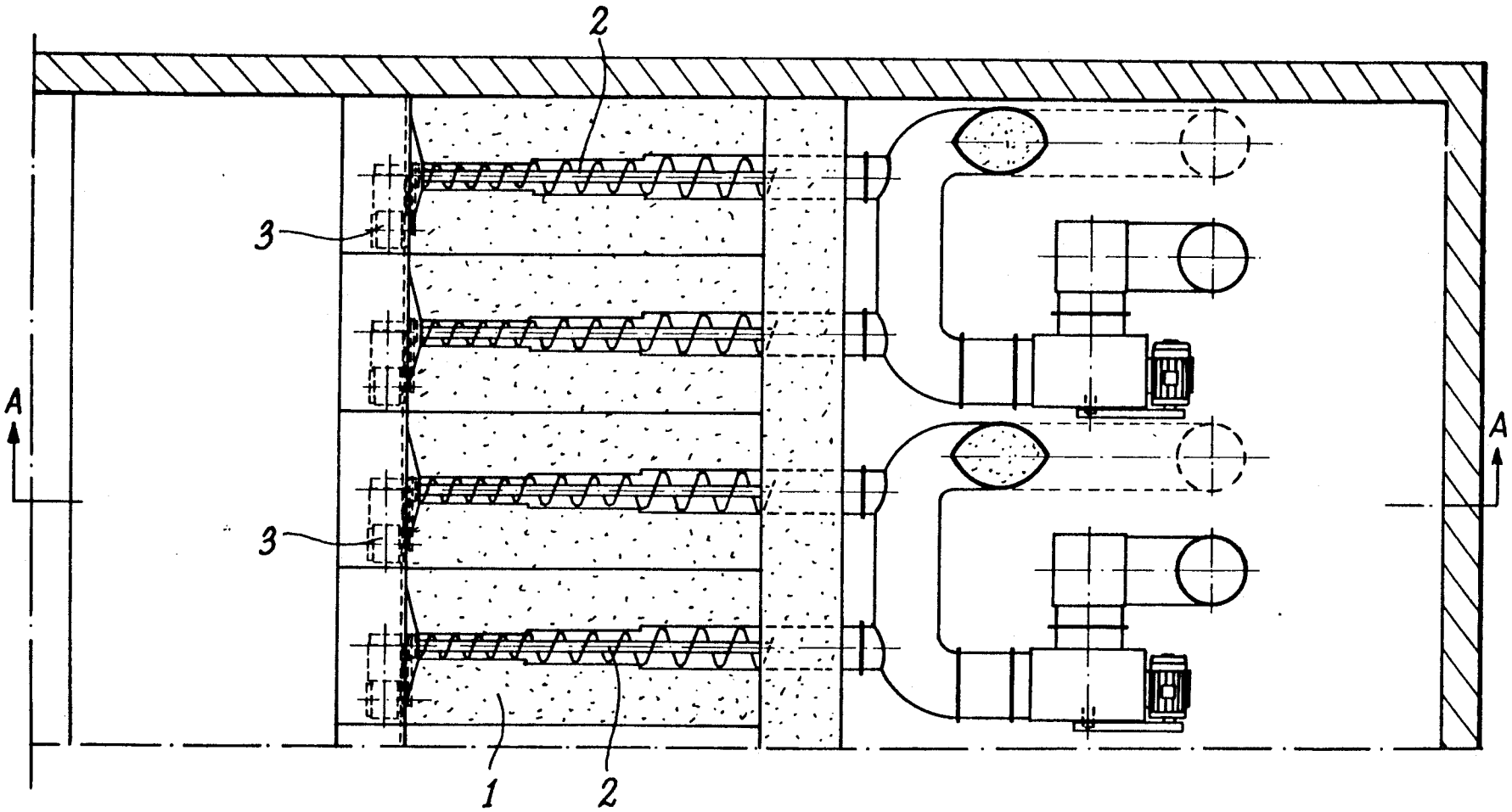
FIG. 1 is a plan view of an embodiment of the assembly according to the present invention.
Figure 2:
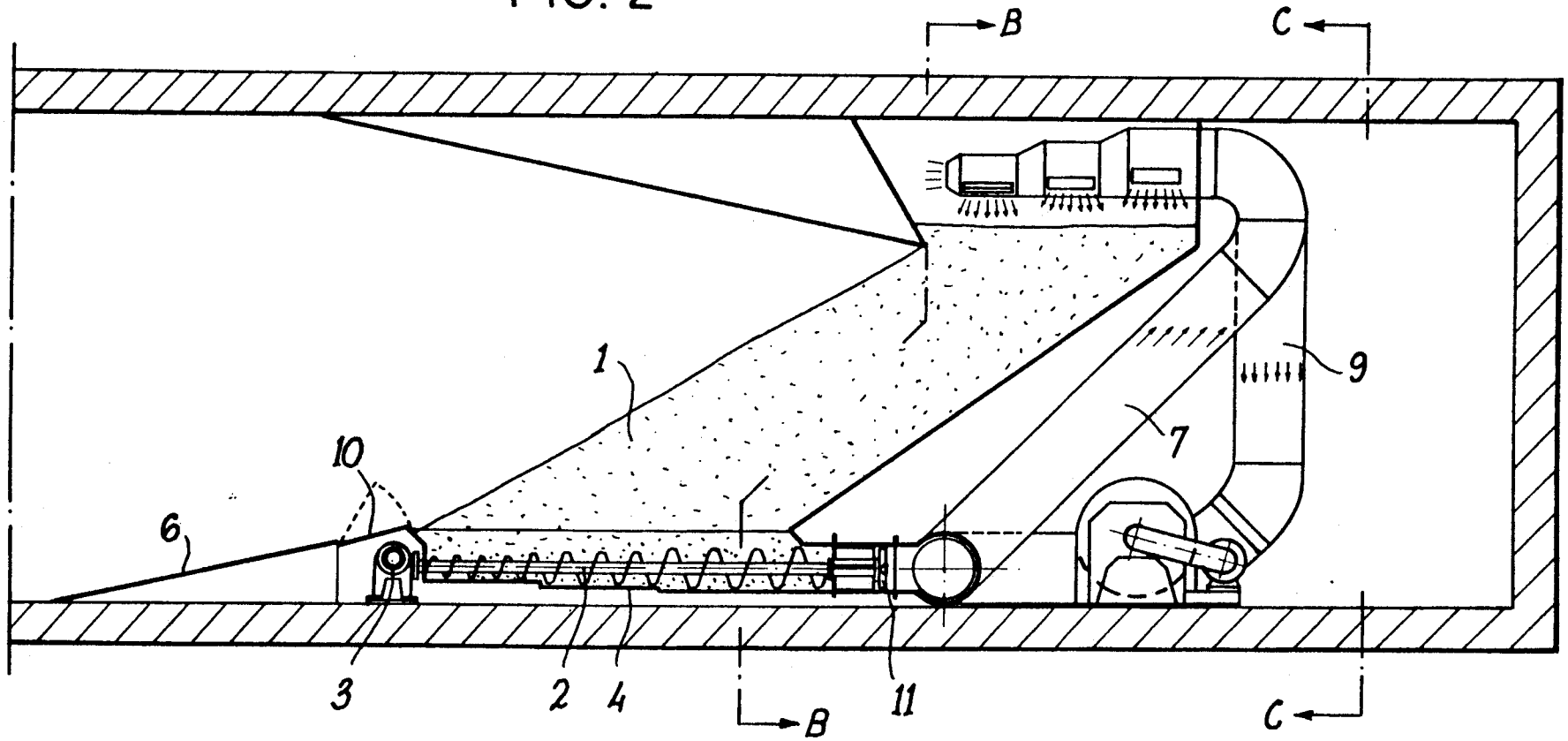
FIG. 2 is a cross-sectional view taken along the line A—A of FIG. 1.
Figure 3:
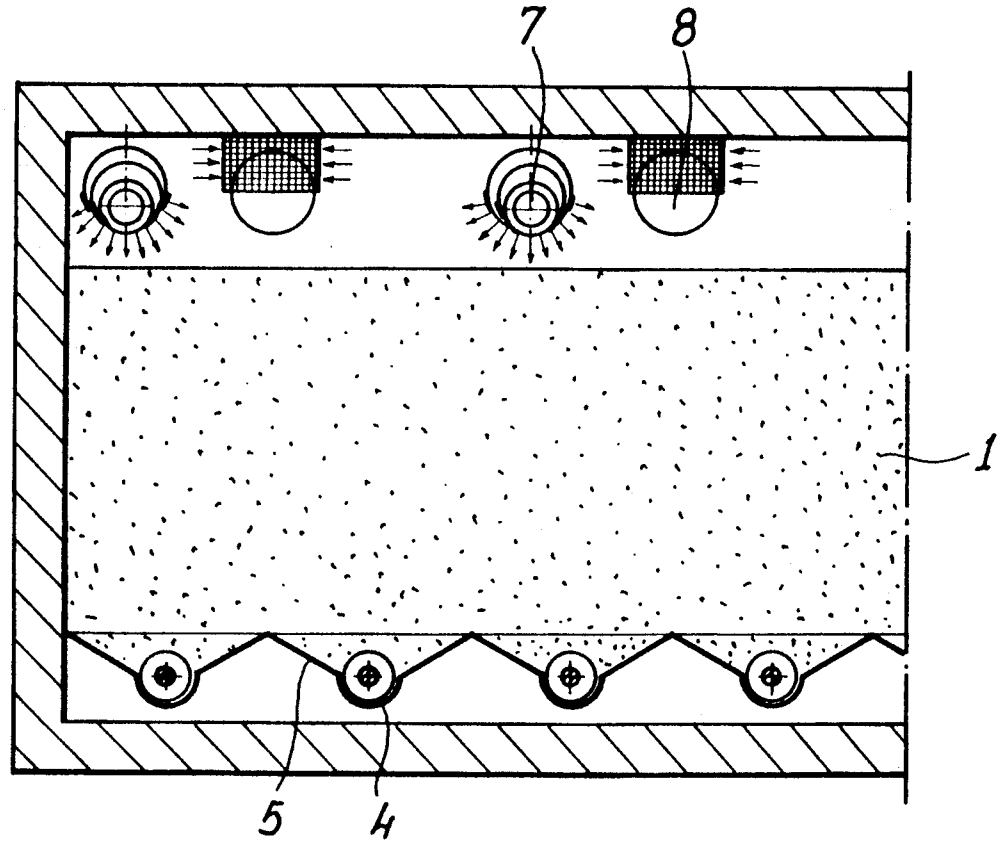
FIG. 3 is a cross-sectional view taken along the line B—B of FIG. 2.
Figure 4:
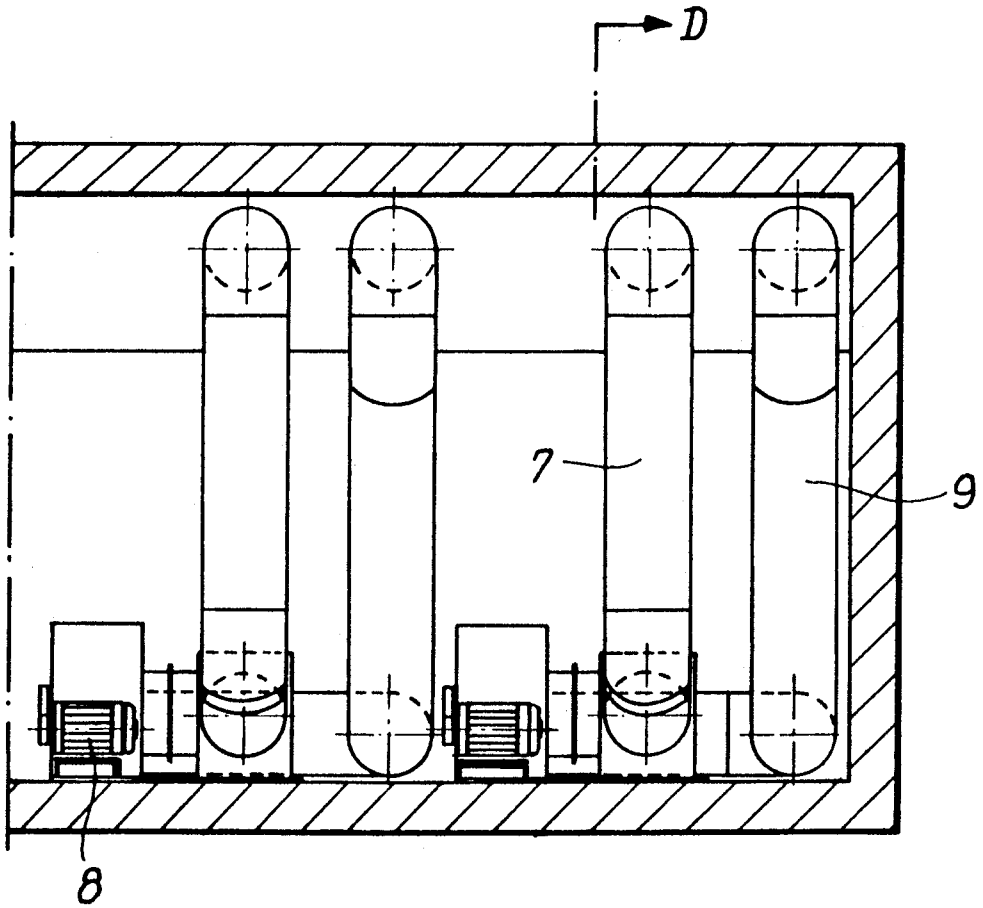
FIG. 4 is a cross-sectional view taken along the line C—C of FIG. 2.

Each one of said worm screws 2 is contained in a half cylinder 4 which is half open at its upper portion, and inclined metal plates 5 facilitate the flow of the material and projectiles by gravity towards the worm screws 2 as shown in FIGS. 2 and 3.

In the embodiment shown in FIGS. 1-4, with the worm screw 2 assembled at the level of the firing floor of the firing range, a plate 6 is provided in front of the driving means 3, said plate serving the purpose of deflecting mis-directed in-flight projectiles.

The rear part of each half cylinder 4 is connected to the conveyor conduits 7, through which air forced by electric fan 8 passes at high speed.

The lighter granulated material is then moved by the high speed air stream to the top of the heap 1 through the pneumatic conveyor 7, while air is taken in again through the conduit 9.

The horizontal shaft of the worm screw 2 is connected to the driving means 3 through ratiomotors that can be inspected through a door 10.

Ball bearings supported by metallic plates which are arranged inside said half cylinder 4 at points corresponding to the rear part of the horizontal shaft of the worm screw 2 keep the coaxial shaft in place. Said metallic plates in addition make the flow of the material more regular.

Moreover, the rear end of the shaft of the worm screw 2 causes the vanes 11 to rotate, said vanes giving rise to the disintegration of any material that has caked during the passage through the worm screw 2.

The separation of the granulated material from the heavy projectiles occurs at the base of the delivery conduit 7, said separation being achieved by the force of gravity on the projectiles, which cannot be overcome by the moving air stream, as is the case with the lighter granulated material.

The plate 6 for protection of the driving means 3 is at a slope of 8°, and rises from the floor by about 40 cm.

Each one of the modules of said ballistic projectile arrester is of 2.40 m width and the modules can be coupled so as to obtain a total width that is an integral multiple of 2.40 m according to the actual requirements.

Figure 5:
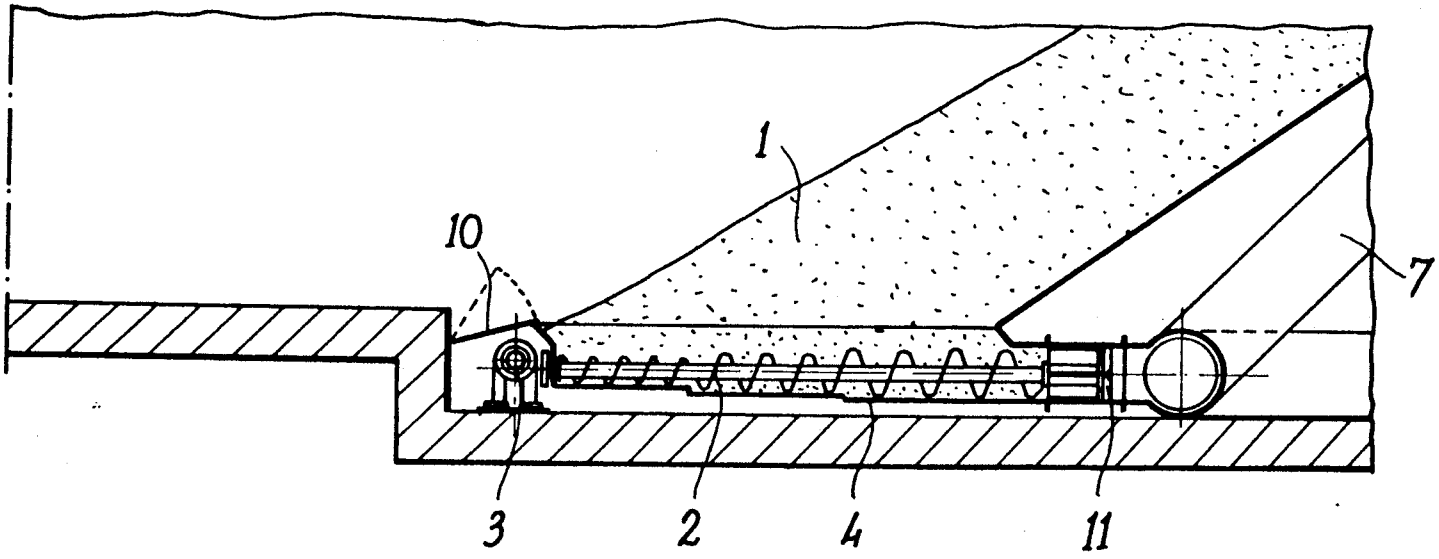
FIG. 5 is a longitudinal cross-sectional view of a second embodiment of the assembly according to the present invention.

According to the embodiment shown in FIG. 5, the only difference is that the assembly according to the present invention is arranged in a depression in the firing floor of the firing range, of about 40 cm depth, so that it is not necessary to provide the plate 6. Thus, the depression is only deep enough to receive the worm screw 2 driving means 3, half cylinder 4 and inclined plates 5.

Obviously, the assembly according to the present invention can be provided with mechanical means for conveying the separated granulated material to the top of the heap.

This invention has been disclosed with specific reference to some preferred embodiments, but it is to be understood that modifications and/or changes can be introduced by those who are skilled in the art without departing from the spirit and the scope of the invention.

We claim:

1. A firing range having a firing floor, means for arresting ballistic projectiles comprising a heap of granular material extending above the floor, means at the bottom of said heap for mechanically conveying granular material and projectiles therein comprising at least one worm screw having at least three different diameters the sizes of which progressively increase in the direction of movement of said material and projectiles, a half cylinder open at the top in which said worm screw is positioned, and means for driving said worm screw, pneumatic conveying means comprising conduits and a fan for receiving granular material and projectiles from said worm screw, and for conveying only said granular materials to the top of said heap and for depositing said conveyed granular material onto said heap, said mechanical conveying means and said pneumatic conveying means being at substantially the level of said firing floor.

2. The firing range of claim 1, wherein a plurality of said means for mechanically conveying granular material and projectiles therein are provided in spaced, substantially parallel relationship.

3. The firing range of claim 2 and means comprising inclined plates for causing granular material and projectiles to flow laterally to said worm screw.

4. The firing range of claim 1, said worm screw comprising a shaft extending beyond the end of said worm screw closest to said pneumatic conveying means, and vanes for disintegrating caked granular material carried by said shaft adjacent said end thereof.

5. The firing range of claim 1, said heap of granular material having a free slope.

6. The firing range of claim 1, said worm screw having a shaft, said means for driving said worm screw comprising driving means connected to said shaft remote from said pneumatic conveying means.

7. The firing range of claim 1, said means for mechanically conveying being above the level of the floor of said firing range.

8. The firing range of claim 7, and further comprising means for protecting said mechanical conveying means from in flight ballistic projectiles comprising a plate sloping upwardly from the floor in a direction to deflect in flight projectiles into said heap of granular material.

9. The firing range of claim 1, wherein said mechanical conveying means has portions below the level of said firing floor.

10. The firing range of claim 1, wherein a depression is provided in said floor of said firing range generally beneath said heap of granular material, said depression being only sufficiently deep to receive said mechanical conveying means, said mechanical conveying means being in said depression.

* * * * *